US007789616B2

(12) United States Patent
Yen et al.

(10) Patent No.: US 7,789,616 B2
(45) Date of Patent: Sep. 7, 2010

(54) ROTOR MECHANISM OF CENTRIFUGAL COMPRESSOR

(75) Inventors: Cheng-Chung Yen, Hsinchu (TW); Chung-Ping Chiang, Hsinchu (TW); Jiing-Fu Chen, Hsinchu (TW); Yung-Lo Chow, Hsinchu (TW); Chun-Han Chen, Hsinchu (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 668 days.

(21) Appl. No.: 11/878,985

(22) Filed: Jul. 30, 2007

(65) Prior Publication Data

US 2008/0152478 A1 Jun. 26, 2008

(30) Foreign Application Priority Data

Dec. 26, 2006 (TW) ..... 95148895 A

(51) Int. Cl.
*F04D 29/06* (2006.01)

(52) U.S. Cl. ..... 415/111; 415/229; 415/230; 415/174.5; 416/198 R

(58) Field of Classification Search ..... 415/206, 415/174.5, 229, 230, 111, 112; 416/198 R, 416/198 A; 417/423.12, 423.13; 184/13.1
See application file for complete search history.

(56) References Cited

U.S. PATENT DOCUMENTS 2,592,387 A * 4/1952 Brown ..... 384/480
3,004,782 A * 10/1961 Meermans ..... 277/347
3,004,806 A * 10/1961 Schinnerer ..... 384/468
3,017,230 A * 1/1962 Meermans ..... 384/479
4,938,664 A 7/1990 Zinsmeyer
4,997,340 A 3/1991 Zinsmeyer et al.

FOREIGN PATENT DOCUMENTS

CN 1216804 5/1999
CN 2620098 Y 6/2004

* cited by examiner

*Primary Examiner*—Ninh H Nguyen
(74) *Attorney, Agent, or Firm*—Rabin & Berdo, P.C.

(57) ABSTRACT

A rotor mechanism of a centrifugal compressor connectable to a power output device and configured to block leakage of lubricants and to recycle lubricants to an oil sump is provided, which includes a rotary shaft with a rolling bearing and a screw nut, a bearing housing for receiving the rolling bearing, and a bearing plate connected to the bearing housing. The screw nut has a surface provided with an oil throw seal, and the bearing housing. As the bearing plate is provided with an oil channel in contact with the oil-returning hole and either one of the bearing housing and the bearing plate is provided with a first labyrinth seal in contact with the screw nut, lubricants leaking out of the rolling bearing is allowed to go to the oil sump via the oil channel and oil-returning hole. The oil slinger thus blocks the lubricants from leaking out of the first labyrinth seal.

20 Claims, 7 Drawing Sheets

ROTOR MECHANISM OF CENTRIFUGAL COMPRESSOR

BACKGROUND OF THE INVENTION

1. Field of the Invention

The present invention relates to centrifugal compressors, and more particularly, to a rotor mechanism of a centrifugal compressor for blocking leakage of lubricants and recycling of lubricants.

2. Description of the Prior Art

With continual advancement in compressor technology, requirements for rotational speeds and performance of compressors also increase. As shown in FIG. 1, U.S. Pat. No. 4,938,664 has disclosed an oil reclaim system for use in a centrifugal compressor, wherein a high-pressure refrigerant is used to drive and guide the lubricant to go from an inlet 102 to an oil sump 101 along the lower border of the casing. The refrigerant is rotationally compressed by vanes 100. A jet pump 106 pumps the lubricant to go from an opening 105 to the oil sump 101 via a low-pressure pipe 104. Subjected to the pumping of the jet pump 106, a high-pressure refrigerant gas goes from an opening 108 to the oil sump 101 via a high-pressure pipe 107 so as to block the lubricant from accumulating in the lower region after the refrigerant is introduced.

Although U.S. Pat. No. 4,938,664 provides a design for recycling lubricant, it does not teach effective means for blocking contamination of refrigerant loop caused by leakage of lubricants. This is particularly true in the case where the refrigerant loop is the high pressure end and a hydrodynamic bearing is used to support a rotary shaft, because a longer period of time is required to establish supporting oil pressure during actuation. The reason for such a requirement is that it is extremely easy for the lubricant to leak into the refrigerant loop to contaminate the purity of the refrigerant if a pressure difference is not established. Moreover, hydrodynamic bearings are known for poor efficiency, low rigidity, and long time for establishing oil pressure establishing time as mentioned previously. Surfaces of the hydrodynamic bearings are extremely soft, such that they are extremely likely to be damaged when the compressor comes to a sudden halt. Also, if the lubricant liquids fail to meet the high purity requirement for refrigerants, they may be mixed with the lubricant gases when the lubricant gases are being separated.

Referring to FIG. 2, U.S. Pat. No. 4,997,340 has disclosed a sealing device for use in a buffer region of a centrifugal compressor, wherein the sealing device is used for sealing a transmission region and a motor power region, to reduce drop in efficiency and to prevent the refrigerant from leaking into the motor power region from the transmission region. The sealing device comprises a labyrinth seal 113 installed between a buffer region 112 and a transmission region 109. The labyrinth seal 113 contacts the region where an impeller 110 is situated via a pore. Because the pressure of air current compression and refrigerant gas in the region is slightly higher than that in the transmission region 109, leakage of the lubricant into the buffer region 112 (connected to the motor power region) is stopped and the lubricant are guided back to the oil sump 111 after the pressure of the high-pressure refrigerant gas has reached the labyrinth seal 113.

Although U.S. Pat. No. 4,997,340 is better than the prior art by teaching the labyrinth seal 113, the cochlear pressure of the centrifugal compressor is still low when the centrifugal compressor is actuated and the lubricant for lubricating a bearing may leak into the refrigerant loop along the high-speed shaft or through the labyrinth seal 113. The leakage must therefore be blocked to avoid loss of lubricants, particularly since the hydrodynamic bearings are known for poor efficiency, low rigidity, and long time for establishing oil pressure when actuated, as well as easy damages to the extremely soft surfaces thereof when the compressor comes to a halt suddenly. After actuation, the high-pressure refrigerant compressed by the impeller 110 may also leak into a lower pressure area along gaps, resulting in a loss of the refrigerant and a decrease in the compressor efficiency. Thus, to increase the compressor efficiency, it is necessary to block the leakage.

The two aforesaid patents can provide effective recycling of lubricant for centrifugal compressors, but there are doubts on the efficiency of separation of refrigerants and lubricant sealing. In particular, it would be a major defect if the leakage of lubricants into the region where the impellor is positioned cannot be blocked. At the same time, by simply implementing the labyrinth seal cannot ensure insulation, because longer time is required for establishing a pressure and the maintenance of the centrifugal compressor is poor. Moreover, due to the axial force arisen from a dorsal pressure difference, the use of a single impellor is also likely to cause leakage.

SUMMARY OF THE INVENTION

In view of the aforesaid drawbacks, it is therefore an objective of this invention to provide a rotor mechanism of a centrifugal compressor to enhance sealing effects to block contamination of the refrigerant loop by lubricants.

It is another objective of this invention to provide a rotor mechanism of a centrifugal compressor to avoid leakage of high-pressure refrigerants.

It is still another objective of this invention to provide a rotor mechanism of a centrifugal compressor, which uses a rolling bearing to increase the efficiency of the compressor.

It is yet another objective of this invention to provide a rotor mechanism of a centrifugal compressor to increase the efficiency of recycling of lubricants.

In accordance with the foregoing and other objectives, the invention proposes a rotor mechanism of a centrifugal compressor, which is connectible to a power output device and used for blocking leakage of lubricants and recycling the lubricants to an oil sump. The rotor mechanism comprises: a rotary shaft comprising a drive side and a transmission side and a connecting portion connected to the power output device, a rolling bearing, and a screw nut are provided in sequence from the drive side to the transmission side, the screw nut is used to fasten and secure the rolling bearing in the rotary shaft, and has a an oil slinger facing the surface of the drive side, the transmission side has at least a impellor positioned thereon; a bearing housing positioned at the drive side of the rotary shaft is configured to receive the rolling bearing, the bearing housing is formed with an oil-returning hole facing the drive side; and a bearing plate disposed around the screw nut and is connected to the bearing housing, the bearing plate is further configured to secure the rolling bearing in position, and has a first labyrinth seal in contact with the surface of the screw nut and an oil channel in contact with the oil-returning hole to guide the lubricants leaked out of the rolling bearing to go to the oil sump via the oil channel and the oil-returning hole and to block leakage of lubricants out of the first labyrinth seal by the oil slinger.

The present invention further proposes a rotor mechanism of a centrifugal compressor, which is connectible to a power output device and is used for blocking leakage of lubricants and recycling of lubricants to an oil sump. The rotor mechanism comprises: a rotary shaft comprising a drive side and a transmission side, a connecting portion connected to the power output device, a rolling bearing, and a screw nut are provided in sequence from the drive side to the transmission side, the screw nut is used to fasten and secure the rolling bearing in position on the rotary shaft and has a an oil slinger facing the surface of the drive side; a bearing housing disposed around the screw nut is configured to receive and secure the rolling bearing in position to block route to the transmission side, and has an oil-returning hole facing the drive side and a first labyrinth seal in contact with the surface of the screw nut; and a bearing plate positioned at the drive side of the rotary shaft and is connected to the bearing housing, the bearing plate has an oil channel in contact with the oil-returning hole to guide the lubricants leaked out of the rolling bearing to go to the oil sump via the oil channel and the oil-returning hole and to block leakage of lubricants out of the first labyrinth seal by the oil slinger.

The aforesaid rolling bearing may be a ball bearing or a roller bearing. The oil slinger is either a circular groove-like structure or a circular protruding structure, formed on the rim of the screw nut. In a preferred embodiment, the first impeller facing the drive side may be connected to a second labyrinth bushing, which is has a second labyrinth seal for engaging with the first impeller. In another preferred embodiment, a second impeller is positioned at the transmission side of the rotary shaft and adjacent to the first impeller. In still another preferred embodiment, an intermediate spacing seal is positioned at the transmission side of the rotary shaft and between the first impeller and the second impeller. Preferably, the side of the second impeller near the intermediate is engaged with a third labyrinth bushing, which has a third labyrinth seal for engaging with the intermediate spacing seal. Moreover, a shoulder portion of the second impeller is formed with a plurality of contact hole for contacting with the back of the second impeller.

A hydrodynamic bearing is typically used in the rotary shaft of a conventional centrifugal compressor. By contrast, the present invention uses a relatively more efficient rolling bearing to replace a hydrodynamic bearing as a supportive structure. The rolling bearing is secured in position in rotary shaft by the use of a screw nut. Then, the rolling bearing is placed inside a bearing housing. One end of the rolling bearing is secured in position to the bearing housing by use of a bearing plate. Because the screw nut has an oil slinger, a bearing plate having an oil channel and a first labyrinth seal positioned on either the bearing plate or the bearing block to engage with the screw nut, the lubricants are guided from the rolling bearing and the oil-returning hole to the oil sump via the oil channel and the oil-returning hole. Moreover, by positioning the second labyrinth and the third labyrinth in appropriately, the loss of high-pressure refrigerants can be effectively blocked to increase the efficiency of the compressor. The plurality of contact hole on the shoulder portion of the second impellor are used for contacting externally via the dorsal side of the second impeller to make the high-pressure refrigerant enter the inlet end. This will reduce the pressure on the dorsal side of the second impeller, because an axial force is generated. Hole. Accordingly, the present invention overcomes the drawbacks in the prior art, and therefore has a high industrial applicability.

DETAILED DESCRIPTION OF THE PREFERRED EMBODIMENTS

The following embodiments are provided to illustrate the present invention. Persons having ordinary skills in the art can easily appreciate technical feature and the achieved functions of the present invention.

Figure 1:
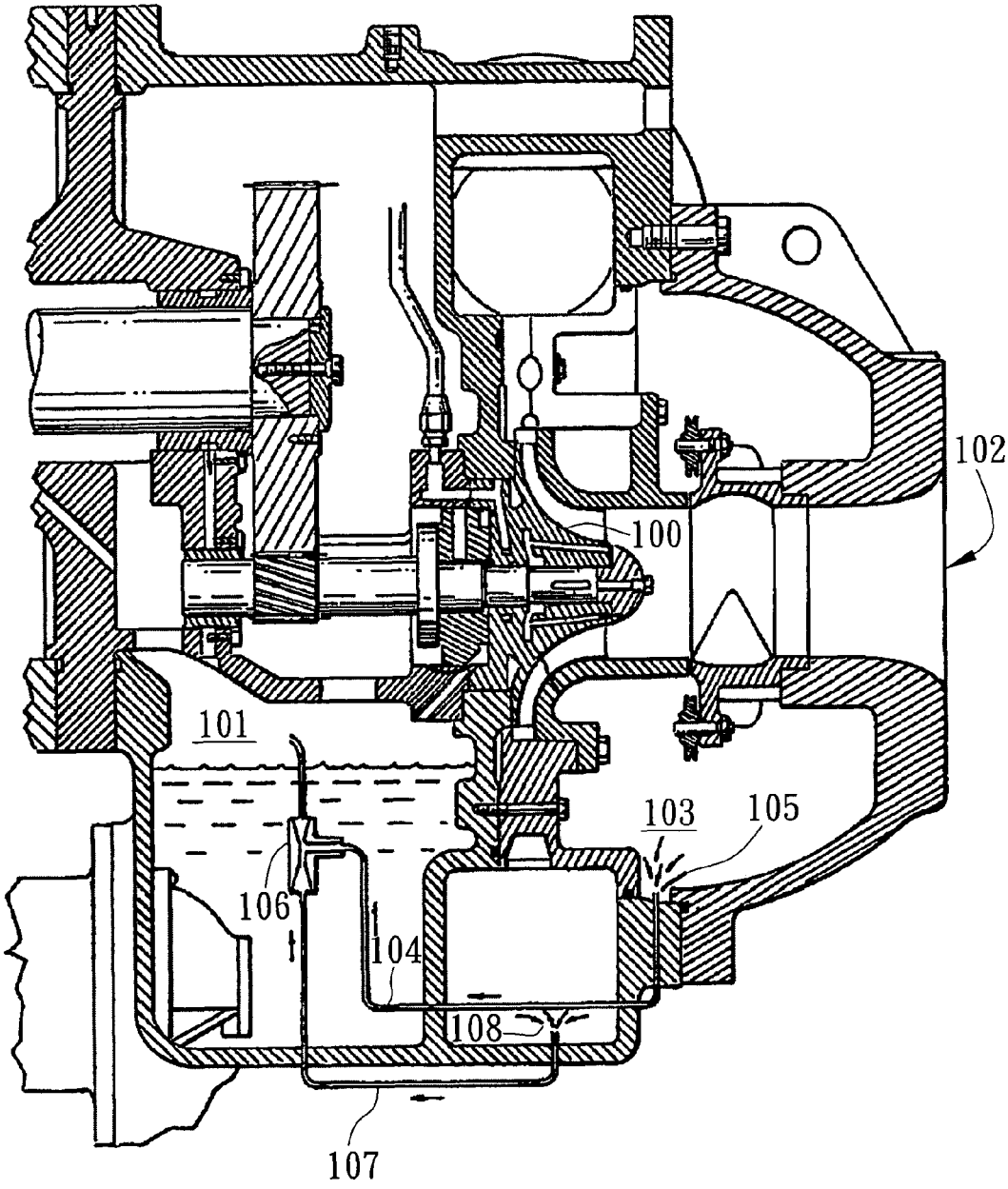
FIG. 1 (PRIOR ART)
FIG. 1 is a cross-sectional view showing a lubricant recycling device of the U.S. Pat. No. 4,938,664.
Figure 2:
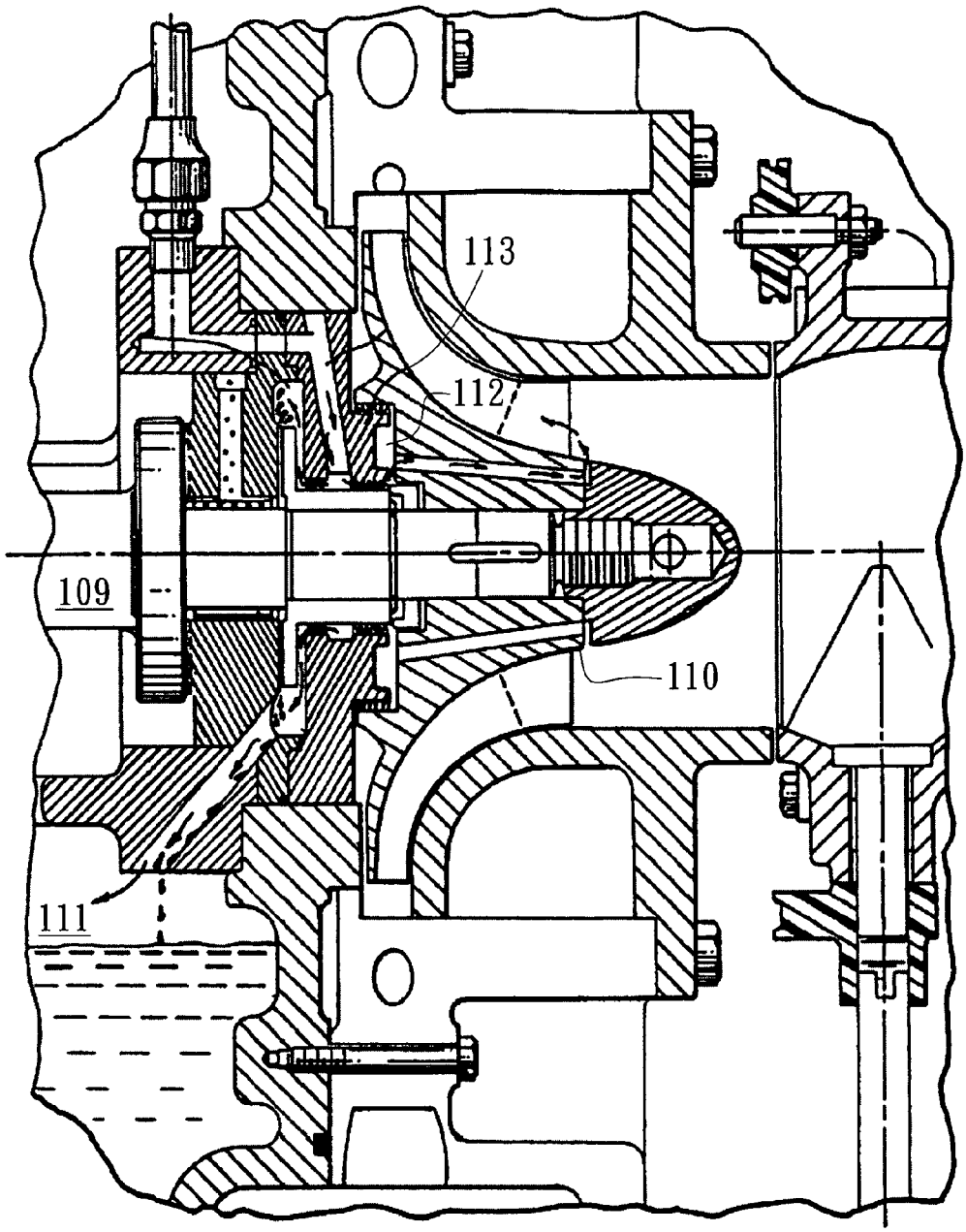
FIG. 2 (PRIOR ART)
FIG. 2 is a cross-sectional view showing a sealing device of the U.S. Pat. No. 4,997,340.
Figure 3:
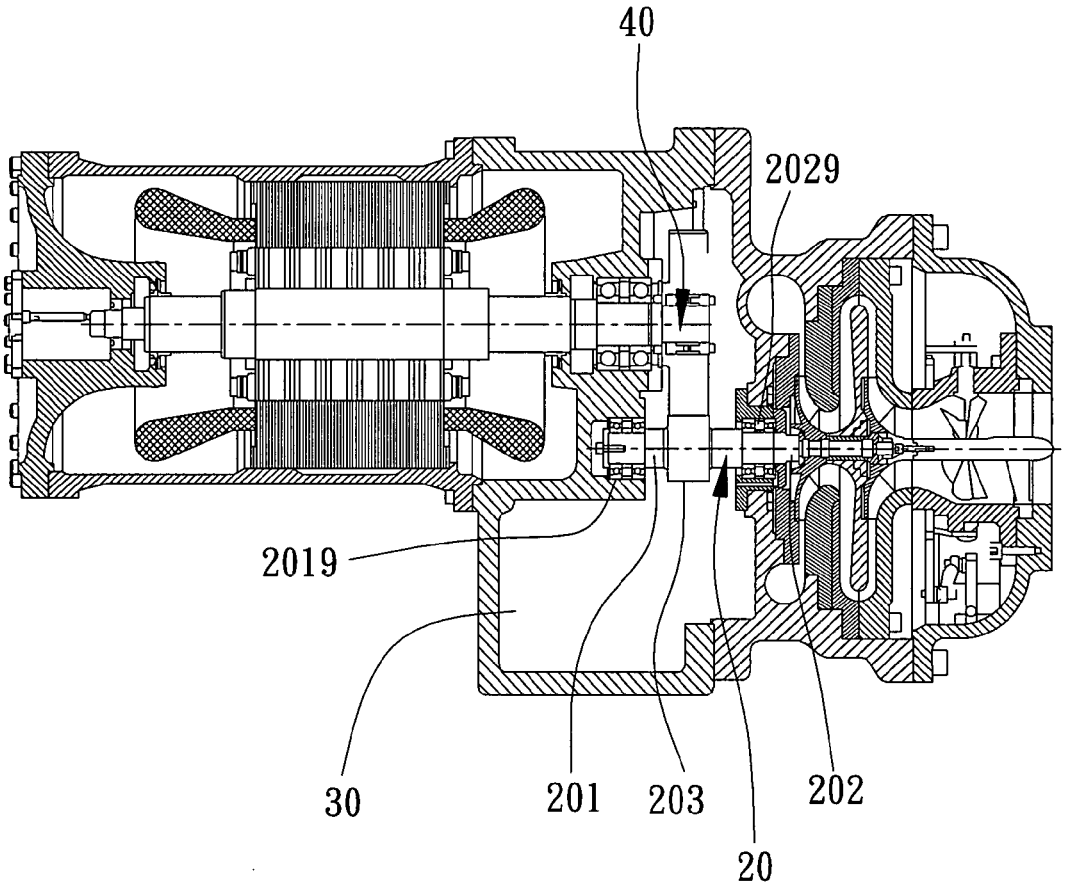
FIG. 3 is a cross-sectional view showing a rotor mechanism implemented in a centrifugal compressor of the present invention.
Figure 4:
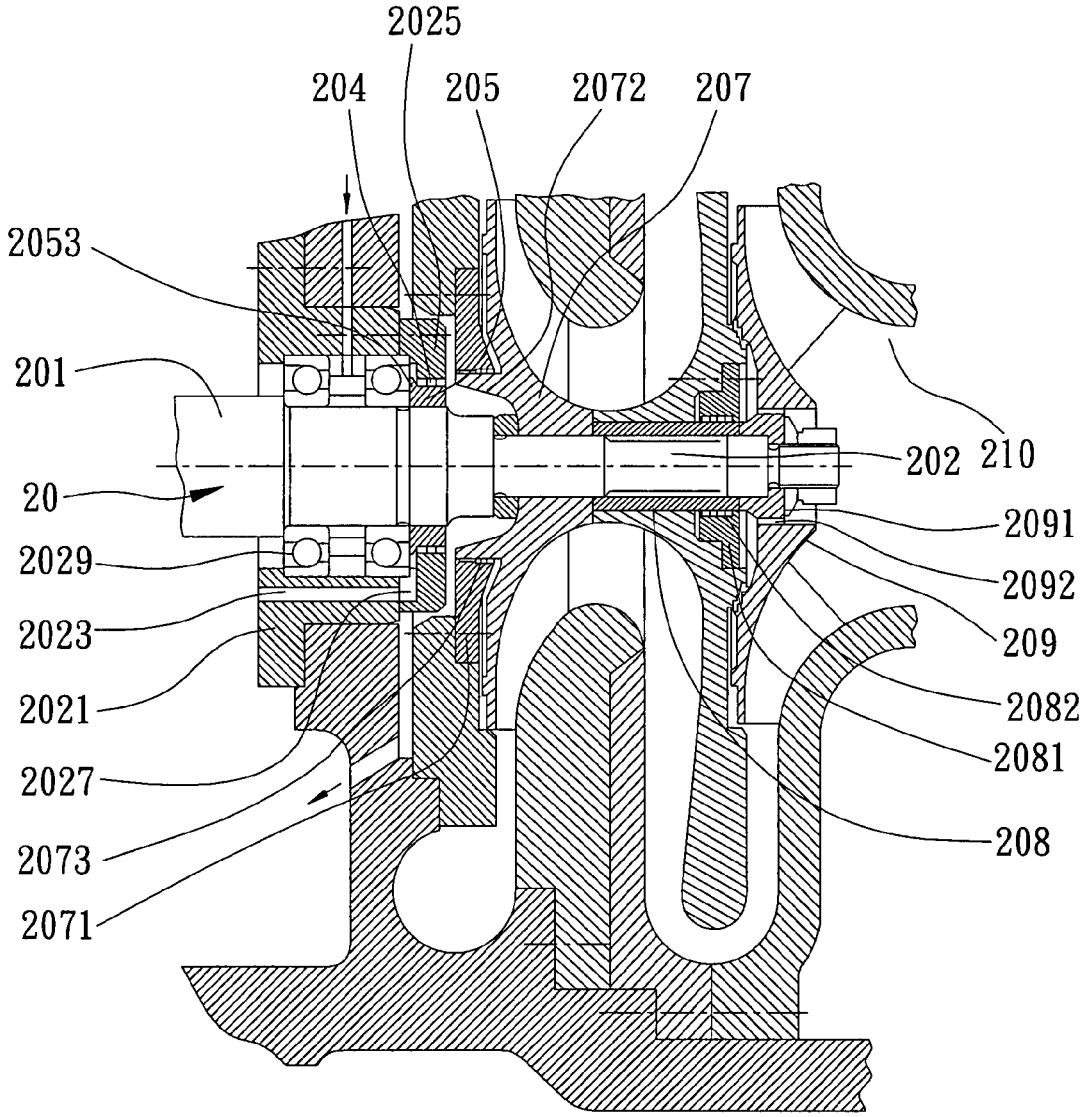
FIG. 4 is a partially expanded schematic diagram of FIG. 3.

Referring to FIGS. 3 and 4, the present invention proposes a rotor mechanism of a centrifugal compressor. The rotor mechanism is connectable to a power output device 40, and is used for blocking leakage of lubricants and recycling of lubricants to an oil sump 30. The rotor mechanism comprises a rotary shaft 20, a bearing housing 2021, and a bearing plate 2025. The rotary shaft 20 comprises a drive side 201 and a transmission side 202. A connecting portion 203 connected to the power output device 40, a rolling bearing 2029, and a screw nut 205 for securing are provided in sequence from the drive side 201 to the transmission side 202. The screw nut 205 secures the rolling bearing 2029 in position in the rotary shaft and has an oil slinger 2053 facing the surface of the drive side 201. The drive side 202 has at least a first impeller disposed thereof. The bearing housing 2021 is positioned at the drive side 201 of the rotary shaft 20, and configured to receive the rolling bearing 2029. The bearing housing 2021 has an oil-returning hole 2023 facing the drive side 201. The bearing plate 2025 is disposed around the screw nut 205 and is connected to the bearing housing 2021. The bearing housing 2021 is further configured for securing the rolling bearing 2029, which has a first labyrinth seal 204 in contact with the surface of the screw nut 205 and an oil channel 2027 in contact with the oil-returning hole 2023. Lubricants leaking from the rolling bearing 2029 go to the oil sump 30 via the oil channel 2027 and the oil-returning hole 2023. The oil slinger 2053 blocks the lubricants from leaking out of the first labyrinth seal 204.

In this embodiment, a rolling bearing 2019 is positioned at the end of the drive side 201 of the rotary shaft 20. The rolling bearing 2019 is similar to the previously mentioned rolling bearing 2029 in the way that both are implemented as ball bearings or roller bearings. Next, the first impeller 207 facing the transmission end 210 is connected to a second labyrinth bushing 2071, which has a second labyrinth seal 2073. The dorsal side of the first impeller 207 is formed with a flange 2072 for connecting to the second labyrinth seal 2073, so as to enable a tight engagement between the flange 2072 of the first impeller 207 and the second labyrinth seal 2073. Moreover, the rotor mechanism has a second impeller 209 positioned at the transmission side 202 of the rotary shaft 20, and the second impeller 209 is adjacent to the first impeller 207. An intermediate spacing seal 208 is positioned at the transmission side 202 of the rotary shaft 20 and between the first impeller 207 and the second impeller 209. The side of the second impellor 209 near the intermediate spacing seal 208 is connected to a third labyrinth bushing 2081, which has a third labyrinth seal 2082 for a tight engagement with the intermediate spacing seal 208. Furthermore, a shoulder portion 2091 of the second impeller 209 is formed with a plurality of contact hole 2092 for contacting with the dorsal side of the second impeller 209. That is, the contact holes 2092 contact with an inlet 210, which lets in a high-pressure refrigerant 33. The second impeller 209 is near the inlet 210 and is regarded as the first level impeller, whereas the first impeller 207 positioned behind the second impeller 209 is regarded as the second level impeller.

Figure 5A:
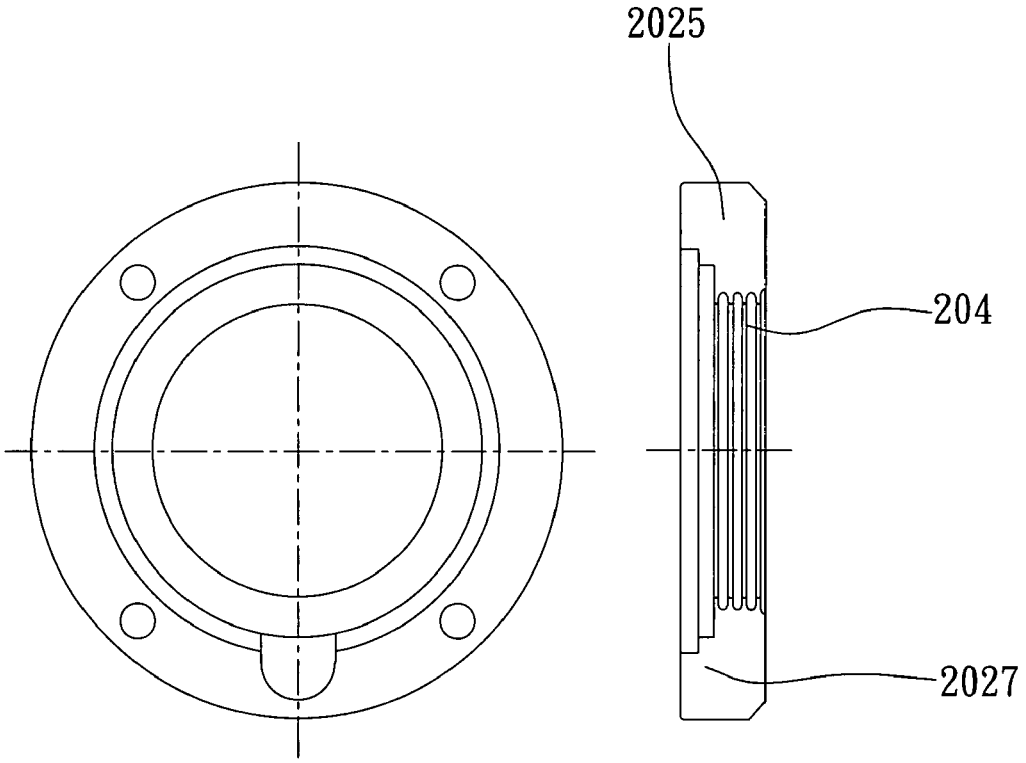
FIG. 5A are two views of a bearing plate of the present invention.
Figure 5C:
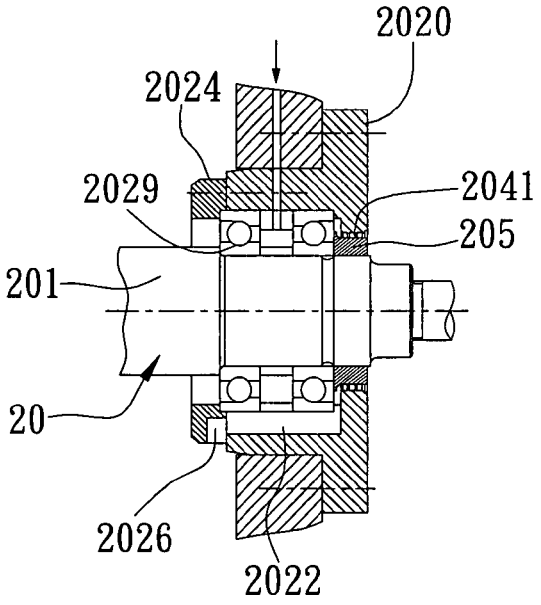
FIGS. 5B and 5C are schematic diagrams of the assembled structures of a bearing plate and a bearing housing utilized by the embodiments of the present invention.

Referring to FIG. 5, the bearing plate 2025 is disposed around the screw nut 205, and is connected to the bearing housing 2021. The bearing plate 2025 has a first labyrinth seal 204 disposed in the inner surface thereof, and the first labyrinth seal 204 contacts with the outer surface of the screw nut 205. Next, the oil channel 2027 is positioned near the bottom of the bearing plate 2025. The oil channel 2027 is spaced apart from the rolling bearing 2029 by an appropriate distance, so as to form a path connecting the rolling bearing 2029 and the oil-returning hole 2023. The path is used for guiding the lubricants leaked out of the rolling bearing 2029 to go to the oil sump 30 via the oil channel 2027 and the oil-returning hole 2023. The oil slinger 2053 blocks leaking of lubricants out of the first labyrinth seal 204.

Figure 5B:
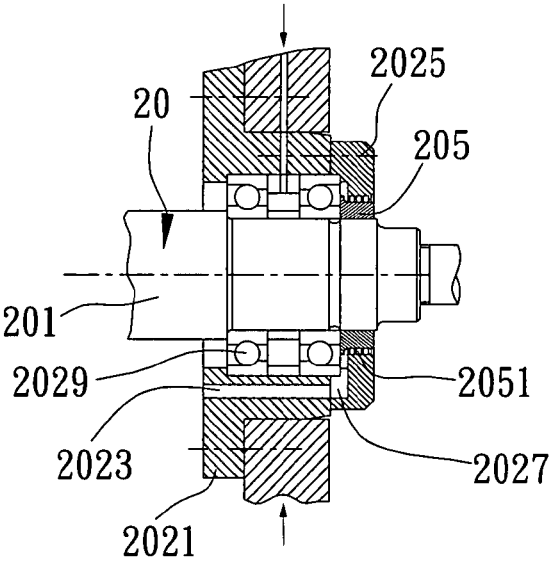

FIG. 5B is a partially expanded schematic diagram of this preferred embodiment. Referring to FIG. 5B, the bearing housing 2021 is positioned at the drive side 201 of the rotary shaft 20, and is configured to receive the rolling bearing 2029. The bearing housing 2021 and has the oil-returning hole 2023 facing the drive side 201. The bearing plate 2025 is disposed around the screw nut 205, and is connected to the bearing housing 2021. The bearing plate 2025 is further configured to secure the rolling bearing 2029. The bearing plate 2025 has the first labyrinth seal 204 in contact with the surface of the screw nut 205 and the oil channel 2027 in contact with the oil-returning hole 2023, thereby forming a route for recycling of lubricants. It should be noted that the present invention is not intended to limit the present invention Referring to FIG. 5C, a bearing housing 2020 is disposed around the screw nut 205, and is configured to receive the rolling bearing 2029. The bearing housing 2020 is further configured to secure the rolling bearing 2029, and has an oil-returning hole 2022 facing the drive side 201 and a first labyrinth 2041 in contact with the screw nut 205. The bearing plate 2024 has is positioned in the drive side 201 of the rotary shaft 20 and is connected to the bearing housing 2020. The bearing plate 2024 is has an oil channel 2026 connected to the oil-returning hole 2022, so as to guide the lubricants leaked from the rolling bearing 2029 to go to the oil sump 30 via the oil-returning hole 2022 and the oil channel 2026, thereby constituting a route for recycling lubricants.

Figure 6A:
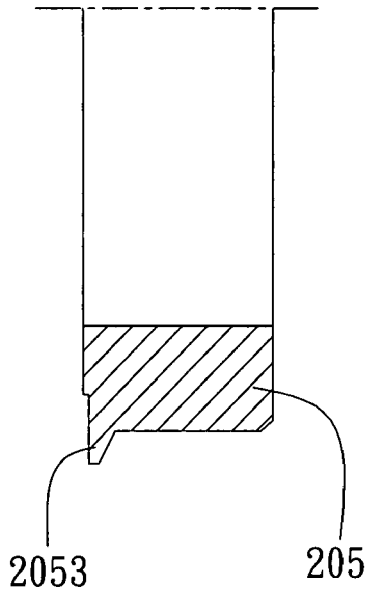
FIGS. 6A and 6B are schematic diagrams of two structures of an oil slinger utilized by the embodiments of the present invention.
Figure 6B:
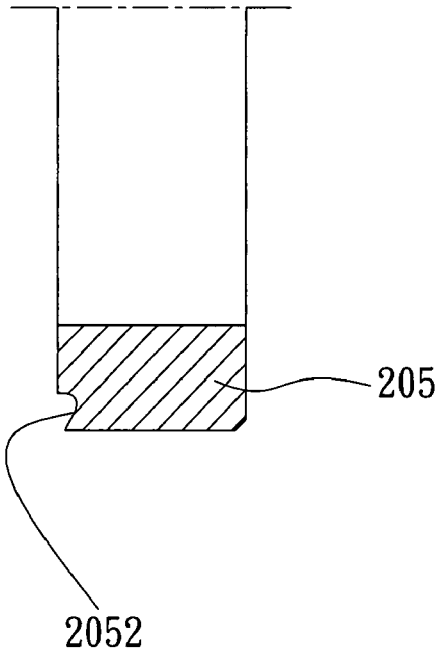

Cross-referencing with FIG. 6A, the oil slinger 2053 on the surface of the screw nut 205 is implemented as a circular protruding structure formed on the rim of the screw nut 205. During a high-speed rotation of the rotary shaft 20, the circular protruding structure makes lubricants fling off from the screw nut 205 by a centrifugal force, to block the lubricants from leaking axially onto the lateral surface of the screw nut 205 and then passing through the first labyrinth seal 204. In light of the disclosure in the embodiment depicted in FIG. 6B, the oil slinger 2052 on the surface of the screw nut 205 is implemented as a circular groove-like structure formed on the rim of the screw nut 205, and the rim of the circular groove-like structure forms a slanted or curved surface. The circular groove-like structure achieves the same function as the circular protruding structure.

A hydrodynamic bearing is typically used in the rotary shaft of a conventional centrifugal compressor. By contrast, the present invention teaches the use of more efficient rolling bearings 2019 and 2029 to replace a hydrodynamic bearing as supportive structures. The rolling bearing 2029 is secured in position in the rotary shaft 20 by a screw nut 205. Then, the rolling bearing 2029 is placed inside a bearing housing 2021. One end of the rolling bearing 2029 is secured in the bearing housing 2021 by the bearing plate 2025. The screw nut 205 is provided with an oil slinger 2053. The bearing plate 2025 or bearing housing 2020 is provided with first labyrinth seals 204 and 2041 for tight engagements with the screw nut 205. Lubricants on the bearings return to an oil sump 30 via the oil channels 2026 and 2027 formed on the bearing plates 2024 and 2025 and the oil-returning holes 2023 and 2022 formed on bearing housings 2020 and 2021. The dorsal side of the first impeller 207 is formed with a flange 2072 connected to the second labyrinth seal 2073. A tight engagement between the flange 2072 and the second labyrinth bushing 2071 blocks leakage of a compressed high-pressure refrigerant 33, to increase the efficiency of the compressor. A third labyrinth brushing 2081 is positioned between an intermediate spacing seal 208 and a second impeller 209. The third labyrinth bushing 2081 uses a third labyrinth seal 2082 thereof for a tight engagement with the intermediate spacing seal 208, thereby reducing a loss of a high-pressure refrigerant 33, to increase the efficiency of the compressor. A shoulder portion 2091 of the second impeller 209 is formed with a plurality of contact holes 2092 for contacting with the dorsal side of the second impeller 209 and the inlet 210, which let in the high-pressure refrigerant 33, thereby lowering the pressure at the dorsal side of the second impeller 209 to reduce the axial pushing force that might otherwise arise from the pressure in the dorsal side of the second impeller 209.

Accordingly, a rotor mechanism of a centrifugal compressor of the present invention provides an excellent sealing effect between the compressor refrigerant and the lubricants, enhances the performance of a rolling bearing, allows easier maintenance, and achieves a good sealing effect in the presence of an oil slinger and a labyrinth seal, not to mention that compression is improved by means of multiple-level impellers.

The invention has been described using exemplary preferred embodiments. However, it is to be understood that the scope of the invention is not limited to the disclosed arrangements. The scope of the claims, therefore, should be accorded the broadest interpretation so as to encompass all such modifications and similar arrangements.

What is claimed is:

1. A rotor mechanism of a centrifugal compressor, the rotor mechanism being connectable to a power output device configured to block leakage of lubricants and to recycle lubricants to an oil sump, the rotor mechanism comprising:

a rotary shaft comprising a drive side and a transmission side, and a connecting portion connected to the power output device, a rolling bearing, and a screw nut provided in sequence from the drive side to the transmission side, the screw nut being used to fasten and secure the rolling bearing in position in the rotary shaft and having an oil slinger facing the surface of the drive side;

a bearing housing positioned at the drive side of the rotary shaft, configured to receive the rolling bearing, and having an oil-returning hole facing the drive side; and a bearing plate disposed around the screw nut and connected to the bearing housing, the bearing plate being further configured to secure the rolling bearing in position and having a first labyrinth seal in contact with a surface of the screw nut and an oil channel in contact with the oil-returning hole.

2. The rotor mechanism of claim 1, wherein the rolling bearing is selected from a ball bearing or a roller bearing.

3. The rotor mechanism of claim 1, further comprising a first impeller positioned at the transmission side of the rotary shaft, and the side of the first impellor facing the bearing plate is connected to a second labyrinth bushing, the second labyrinth brushing has a second labyrinth seal for tight engagements with the first impellor.

4. The rotor mechanism of claim 3, further comprising a second impeller positioned at the transmission side of the rotary shaft, and is adjacent to the first impeller.

5. The rotor mechanism of claim 4, further comprising an intermediate spacing seal at the transmission side of the rotary shaft and between the first impeller and the second impeller.

6. The rotor mechanism of claim 5, wherein the side of the second impellor near the intermediate spacing seal is connected to a third labyrinth bushing, the third labyrinth bushing has a third labyrinth seal for tight engagements with the intermediate spacing seal.

7. The rotor mechanism of claim 6, wherein a shoulder portion of the second impeller is formed with a plurality of contact holes for contacting with the dorsal side of the second impeller.

8. The rotor mechanism of claim 1, wherein the oil slinger is a circular groove-like structure formed on the rim of the screw nut.

9. The rotor mechanism of claim 1, wherein the oil slinger is a circular protruding structure formed on the rim of the screw nut.

10. The rotor mechanism of claim 1, wherein the connecting portion is a gear.

11. A rotor mechanism of a centrifugal compressor, the rotor mechanism being connectable to a power output device and configured to block leakage of lubricants and to recycle lubricants to an oil sump, the rotor mechanism comprising:

a rotary shaft comprising a drive side and a transmission side, and a connecting portion connected to the power output device, a rolling bearing, and a screw nut are provided in sequence from the drive side to the transmission side, and the screw nut being used to fasten and secure the rolling bearing in position in the rotary shaft and having an oil slinger is facing the surface of the drive side;

a bearing housing disposed around the screw nut, configured to receive and secure the rolling bearing, and having an oil-returning hole facing the drive side and a first labyrinth seal in contact with a surface of the screw nut; and a bearing plate positioned at the drive side of the rotary shaft for being connected to the bearing housing, and having an oil channel in contact with the oil-returning hole.

12. The rotor mechanism of claim 11, wherein the rolling bearing is selected from a ball bearing or a roller bearing.

13. The rotor mechanism of claim 11, further comprising a first impeller positioned at the transmission side of the rotary shaft, and the side of the first impellor facing the bearing plate is connected to a second labyrinth bushing, the second labyrinth bushing has a second labyrinth seal for tight engagements with the first impellor.

14. The rotor mechanism of claim 13, further comprising a second impeller positioned at the transmission side of the rotary shaft, and is adjacent to the first impeller.

15. The rotor mechanism of claim 14, further comprising an intermediate spacing seal at the transmission side of the rotary shaft and between the first impeller and the second impeller.

16. The rotor mechanism of claim 15, wherein the side of the second impellor near the intermediate spacing seal is connected to a third labyrinth bushing, the third labyrinth bushing has a third labyrinth seal for tight engagements with the intermediate spacing seal.

17. The rotor mechanism of claim 16, wherein a shoulder portion of the second impeller is formed with a plurality of contact holes for contacting with the dorsal side of the second impeller.

18. The rotor mechanism of claim 11, wherein the oil slinger is a circular groove-like structure formed on the rim of the screw nut.

19. The rotor mechanism of claim 11, wherein the oil slinger is a circular protruding structure formed on the rim of the screw nut.

20. The rotor mechanism of claim 11, wherein the connecting portion is a gear.

* * * * *